United States Patent [19]

Stone

[11] 4,208,814

[45] Jun. 24, 1980

[54] BACKHOE BUCKET EXTENSION DEVICE

[76] Inventor: Richard Stone, P.O. Box 104, Bennett, Colo. 80102

[21] Appl. No.: 932,783

[22] Filed: Aug. 11, 1978

[51] Int. Cl.[2] ..... E02F 3/76

[52] U.S. Cl. ..... 37/117.5; 37/103; 37/DIG. 3

[58] Field of Search ..... 37/117.5, 103, DIG. 3, 37/141 R, 141 T; 414/685, 912

[56] References Cited

U.S. PATENT DOCUMENTS

| | | | |
|---|---|---|---|
| 2,863,233 | 12/1958 | Johnson | 37/117.5 |
| 3,034,237 | 5/1962 | Wolfe et al. | 37/117.5 |

*Primary Examiner*—E. H. Eickholt

*Attorney, Agent, or Firm*—John E. Reilly

[57] ABSTRACT

An extension device for an excavating bucket for increasing the cutting width and capacity of the bucket includes a container of generally the same cross-sectional configuration as the bucket and having attachment means for removably attaching the device on the side of the bucket and cutting edges and tines for cutting and tearing through the soil.

5 Claims, 3 Drawing Figures

BACKHOE BUCKET EXTENSION DEVICE

BACKGROUND OF THE INVENTION

The present invention generally concerns excavation equipment and more particularly a removable extension device adapted to be removably attached to the side of an excavating bucket for increasing the cutting width and capacity of the bucket.

A particularly useful machine developed for excavating trenches is known conventionally as a backhoe, and a quite standard bucket configuration has been developed for such machines. However, since various projects require different widths of trenches, depending to some extent on the design criteria and the purpose for which the trenches are used, most backhoe operators find that their backhoe machine must be equipped with several different sized buckets to accommodate the requirements for various projects. These alternate buckets are expensive, quite heavy, and require a significant additional investment of time, effort and money to keep available for use when different sized tranches are required.

SUMMARY OF THE INVENTION

Accordingly, it is an object of the present invention to provide add-on extension devices which are adapted for attachment to the lateral sides of an excavating bucket to increase the width and capacity of the bucket.

Another object of the present invention is to provide such extension devices for excavating buckets which can be removably attached to the excavating bucket quickly and securely and which are durable and yet easy to handle and attach to the bucket.

Still another object of the present invention is to provide a set of extension devices for excavating buckets that can be added to the bucket selectively to increase width and capacity of the bucket in increments to allow one bucket to be used for excavating several different width trenches.

The add-on extension device of the present invention includes a container of generally the same cross-sectional configuration as the excavating bucket and having reinforced earth cutting edges around its lateral edges and attachment means for removably attaching the extension device to the lateral sides of an excavating bucket. The attachment means include a pair of hooks extending upwardly from a recessed lateral side of the extension device and then curving downwardly for hooking over the lateral edge of the excavating bucket, and a large bolt extending through holes in the lower portions of both the bucket and the extension device. The extension device is also provided with tines along its forward cutting edge similar to those provided along the forward cutting edge of the excavating bucket for ripping the earth. It also has reinforced cutting edges along the remaining upper edges of the container. There are preferably at least two of such extension devices provided for selective attachment to opposite lateral sides of the excavating bucket as desired, depending on the width of the trench to be excavated.

DESCRIPTION OF THE PREFERRED EMBODIMENT

Figure 1:
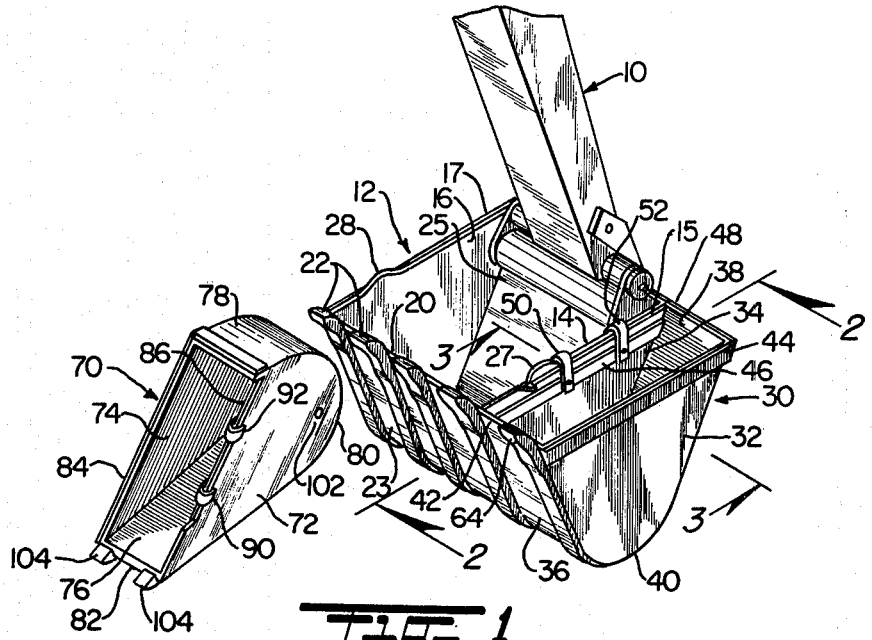
FIG. 1 is a perspective view of an excavating bucket pivotally attached to the boom of a backhoe in a conventional manner and showing one of the extension devices of the present invention attached to the right side of the excavating bucket and another extension device adapted for attachment to the left side of the excavating bucket shown unattached.

Two excavating bucket extension devices 30, 70, in accordance with the present invention, are shown in FIG. 1, the right extension device 30 being attached to the bucket 12, and the left extension device 70 is shown unattached to the bucket 12. The backhoe bucket 12 is shown pivotally attached to a backhoe boom 10 in a conventional manner.

For purposes of background description, the conventional excavating bucket 12 for a backhoe is in the form of an open-topped container having a front panel 23, back panel 25 and bottom panel 24 all connected together in a continuously curved contour into a generally U-shaped transverse cross-sectional configuration, a right side panel 14, and a left side panel 16. The upper perimeter of the bucket 12 has thickened reinforced cutting edges for cutting through soil, as shown on the top edge 15 of the right panel 14, at the top edge 17 of the left panel 16, and on the top edge 20 of front panel 23. The bucket 12 is also equipped with teeth or tines 22 extending upwardly and outwardly from its front panel 23 for ripping the soil.

Figure 2:
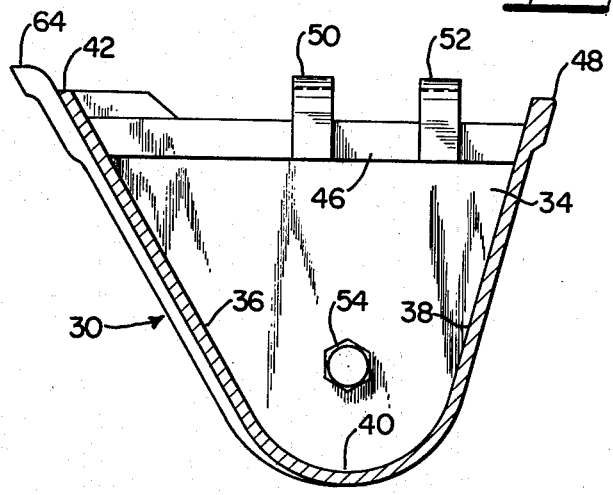
FIG. 2 is a transverse cross-sectional view of the extension device taken along lines 2—2 of FIG. 1.
Figure 3:
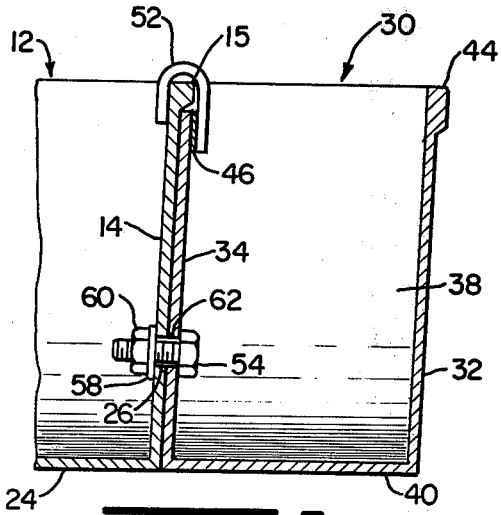
FIG. 3 is a longitudinal cross-sectional view of the extension device and a portion of the bucket taken along lines 3—3 of FIG. 1 and showing the details of the attachment means.

The right extension device 30 and the left extension device 70 are substantially the same with the exception that the attachment means are on opposite sides to accommodate attachment of the extension devices to opposite sides of the bucket 12. Therefore, the detailed description of the right extension device 30 will also be typical for the left extension. It is comprised of an open-topped container having a front panel 36, back panel 38, and bottom panel 40 all contoured together in a generally U-shaped transverse cross-sectional configuration as shown in FIG. 2. The container is enclosed on the sides by right panel 32 and left panel 34. The left panel 34 is adapted to be positioned adjacent right panel 14 of the bucket 12 is flat, contacting relation to each other as shown in FIG. 3, and the top portion of left panel 34 is recessed downwardly a sufficient distance to clear the thickened cutting edge 15 of the bucket 12, as shown in FIG. 3, to adapt the left panel 34 for close fitting abutting contact with right panel 14 of the bucket 12.

The upper edge of left panel 34 is reinforced with an elongated strap 46 along its upper edge. A pair of hooks 50, 52 extend upwardly from the reinforced upper edge 46 of left panel 34 and adapted to curve over the cutting edge 15 of the bucket 12 and return downwardly for suspending the extension device 30 from the right lateral side 14 of the bucket 12. An upward projection 27 on the top edge of right panel 14 of the bucket 12 contacts the forward hook 50 to prevent forward movement of the extension device 30 in relation to the bucket 12. The lower portions of the extension device 30 and the bucket 12 are also fastened together as shown in FIG. 3 by bolt 54 extending through axially aligned holes 62 and 26 in left panel 34 of the extension device 30 and right panel 14 of the bucket 12, respectively. The bolt 54 is secured in the conventional manner with a washer 58 and nut 60.

The upper edges of the forward panel 36, right panel 32, and back panel 38 are provided with thickened cutting edges, 42, 44, 48, respectively, and the extension device 30 is also provided with a pair of tines projecting upwardly and outwardly from the top edge of front panel 36 for ripping the soil.

The left extension device 70 is similarly provided with a front panel 76, back panel 78, and bottom panel 80, all contoured together in a substantial U-shaped transverse cross-sectional configuration, and the sides are enclosed by right panel 72, and left panel 74. The right panel 72 is also recessed and reinforced along its top edge 86 and is provided with front and rear hooks 90, 92, respectively for suspending the extension device 70 from the left side panel 16 of the bucket 12. A hole 102 is provided in the bottom portion of right panel 72 to accommodate further fastening of the panel 72 to the panel 16 with a bolt fastener.

Thickened, reinforced cutting edges 82, 84 and 88 are provided along the top edges of the front, left side and rear panels, respectively, and tines 104 project upwardly and outwardly from the top edge of the front panel 76. The left extension device 70 is therefore attached to the bucket 12 by suspending the hooks 90, 92 over the top edge of the left panel 16 of the bucket 12 with the front hook 90 positioned just rearwardly of the projection 28 on the upper edge of panel 16, and the bottom portions of the panel 72 and the panel 16 are bolted together as similarly described for the attachment of the right extension device 30 to the bucket 12.

It can be appreciated that when the right extension device and left extension device 70 are attached to the right and left sides of the bucket 12, respectively, the effective width of the bucket 12 for excavating a trench is substantially increased, and the capacity of the bucket 12 is similarly increased. Also, if a trench of intermediate width is desired, only one of the extension devices need be used which provides an incremental additional width of only half as much as the additional width provided when both extensions are used. Therefore, the versatility of a conventional backhoe bucket is significantly enhanced. Further, the extension devices 30, 70 are convenient to handle and transport along with the backhoe or other excavating machine for which they are adapted, and they can be mounted on the sides of the bucket 12 relatively quickly and easily when the need arises.

Although the present invention has been described with a certain degree of particularity, it is understood that the present disclosure as been made by way of example and that changes in detail and structure may be made without departing from the spirit thereof.

What is claimed is:

1. In an excavation bucket for a backhoe, which has an open-topped container with a front, back and bottom all formed together in a continuous, contoured, U-shaped configuration, and left and right sidewalls, thickened, reinforced cutting edges around the top perimeter of the container, and tines protruding upwardly and outwardly from the front wall of the container, the improvement comprising:

a first removable extension device 30 having a front panel 36, rear panel 38, and bottom panel 30, all formed together in a continuous, contoured, U-shaped cross-sectional configuration in substantially the same size and shape as the cross-sectional of said bucket, a right side panel 32 and a left side panel 34 which enclose the sides of said device, said left side panel having its top portion recessed downwardly and adapted to be positioned in abutting contact with said right sidewall of said bucket under its thickened cutting edge, a pair of hooks 50, 52 extending upwardly in spaced-apart relation to each other from the left panel 34 and adapted to hook over the top edge of the right side of said bucket for suspending said extension device 30 therefrom, a fastener 54 adapted for fastening the lower portions of said bucket and said extension device together in immovable relation to each other, a cutting edge 42 on the top of the front panel 36, and a tine 64 extending upwardly and outwardly from said front panel 36, and a second removable extension device 70 having a front panel 76, rear panel 78, and bottom panel 80, all formed together in a continuous, contoured, U-shaped cross-sectional configuration in substantially the same size and shape as the cross-section of said bucket, a right side panel 72 and a left side panel 34 which enclose the sides of said device, said right side panel having its top portion recessed downwardly and adapted to be positioned in abutting contact with said left sidewall of said bucket under its thickened cutting edge, a pair of hooks 90, 92 extending upwardly in spaced-apart relation to each other from the right panel 72 and adapted to hook over the top edge of the left side of said bucket for suspending said extension device 70 therefrom, a fastener adapted for fastening the lower portions of said bucket and said extension device together in immovable relation to each other, a cutting edge 82 on the top of the front panel 76, and a tine 104 extending upwardly and outwardly from said front panel 76.

2. Bucket extension apparatus adapted for attachment to an excavating bucket for increasing the width and capacity of said bucket, said bucket being of the type having an open top and opposite side panels disposed in spaced, substantially parallel relation to one another, said side panels having thickened cutting edges along upper edges thereof, said apparatus comprising:

a rigid, unitary container having two sidewalls in spaced-apart relation to each other, with one of said sidewalls adapted to be positioned adjacent to one of said side panels of said excavating bucket, said one sidewall having a top edge that is recessed downwardly a sufficient distance to clear said thickened cutting edge of said excavating bucket, a front wall, a back wall and a bottom wall all rigidly connected together, and said container having an open top; and attachment means adapted for removably attaching said container on the side of said excavating bucket, with one sidewall of said container positioned adjacent to one of said side panels of bucket with the top of said container opening in substantially the same direction as the open top of the bucket.

3. The bucket extension apparatus of claim 2, wherein said sidewalls of said container are each formed with their front and rear tapered to converge downwardly and inwardly toward each other to a rounded bottom edge which is feathered upwardly and outwardly to meet said converging front and rear edges in a smooth, continuous contour.

4. The bucket extension apparatus of claim 2, wherein said attachment means includes a hook-shaped strap extending upwardly from said recessed top edge of said sidewall adjacent said excavating bucket and adapted to hook over said thickened cutting edge of said excavating bucket, said sidewall of said container having a hole located near said bottom wall, said side panel of said excavating bucket having a corresponding hole wherein said holes axially align with each other when said strap is securely hooked over said thickened reinforced cutting edge of said excavating bucket, and a bolt adapted for extension through said holes and fastening said container and said excavating bucket in immovable relation to each other.

5. The bucket extension apparatus of claim 2, including a cutting edge on the top edge of said back wall, and a tine protruding upwardly from said cutting edge on said front wall.

* * * * *

UNITED STATES PATENT AND TRADEMARK OFFICE

CERTIFICATE OF CORRECTION

PATENT NO. : 4,208,814

DATED : June 24, 1980

INVENTOR(S) : Richard Stone

It is certified that error appears in the above—identified patent and that said Letters Patent is hereby corrected as shown below:

Column 1, line 22, cancel "tranches" and substitute -- trenches --.

Column 2, line 47, cancel "is" and substitute -- in --.

IN THE CLAIMS:

Claim 1, Column 3, line 68, cancel "cross-sectional" and substitute -- cross-section --.

Claim 3, Column 4, line 64, after "rear" add -- edges --.

Signed and Sealed this

*Thirtieth* Day of *December 1980*

[SEAL]

*Attest:*

SIDNEY A. DIAMOND

*Attesting Officer*

*Commissioner of Patents and Trademarks*